United States Patent [19]

Grimm et al.

[11] 4,241,589

[45] Dec. 30, 1980

[54] HOUSEHOLD REFRIGERATOR AIR FLOW CONTROL ASSEMBLY

[75] Inventors: Bernard J. Grimm; Richard A. Dossett, both of Louisville, Ky.

[73] Assignee: General Electric Company, Louisville, Ky.

[21] Appl. No.: 71,206

[22] Filed: Aug. 30, 1979

[51] Int. Cl.[3] ..... F25D 23/02; F25D 25/02; F25D 17/04; F25D 11/02

[52] U.S. Cl. ..... 62/265; 62/382; 62/408; 62/441

[58] Field of Search ..... 62/265, 382, 408, 441

[56] References Cited

U.S. PATENT DOCUMENTS

| | | | |
|---|---|---|---|
| 3,108,455 | 10/1963 | Hanson | 62/382 |
| 3,126,721 | 3/1964 | Shove | 62/408 |
| 3,339,377 | 9/1967 | Fellwock | 62/408 |
| 3,364,694 | 1/1968 | Cohen et al. | 62/265 |
| 3,373,576 | 3/1968 | Dodge et al. | 62/408 X |
| 3,473,345 | 10/1969 | Pfeiffer et al. | 62/408 |
| 3,600,905 | 8/1971 | Dymek et al. | 62/408 |
| 3,638,717 | 2/1972 | Harbour et al. | 62/382 X |
| 3,656,314 | 4/1972 | Jung | 62/408 X |
| 3,866,437 | 2/1975 | Spencer | 62/408 |

*Primary Examiner*—Lloyd L. King
*Attorney, Agent, or Firm*—Frederick P. Weidner; Radford M. Reams

[57] ABSTRACT

An air flow control assembly in a refrigerator having a freezer compartment on top and a fresh food compartment on the bottom separated by a partition and interconnected by an air duct located at the rear of the compartments. The air duct has an air inlet opening in the freezer compartment and an air outlet opening in the fresh food compartment. A movable damper opens and closes the air duct outlet opening and a storage pan is located in air flow communication with the air duct outlet opening. The storage pan has a stationary cover. There is a movable control mechanism located at the front of the storage pan, a push rod linkage member cooperating at one end with the damper to open and close the air duct outlet opening upon movement of the push rod linkage member and the other end is connected to the control mechanism for moving the push rod linkage member. With this arrangement, the user of the refrigerator may move the control mechanism to control the amount of cold air flowing around the pan and, thus, control the temperature inside the pan.

10 Claims, 5 Drawing Figures

18
40
32
34
38
44
42
24
28
47
46
48
78
50
76
94
90
98
54
88
87
72
102
104
106
74
52
68
70
86
80
82
96
92
100
64
62
60
89
26
58
51

HOUSEHOLD REFRIGERATOR AIR FLOW CONTROL ASSEMBLY

BACKGROUND OF THE INVENTION

This invention relates to household refrigerators and is more particularly concerned with a combination refrigerator, that is, a refrigerator including a freezer compartment on top and a fresh food compartment below, both of which are cooled by circulating air from the two compartments over a single evaporator employing a single fan to accomplish the circulation. This invention relates to an air flow control assembly for controlling the circulation of air to a storage container, such as a meat pan, in the fresh food compartment of the refrigerator.

Combination refrigerators, including a single evaporator and a single fan for circulating air from the freezer and fresh food compartments over the evaporator are well known. In the operation of such refrigerators, a major portion of the refrigerated air from the evaporator is directed into the freezer compartment while a smaller portion is directed into the fresh food compartment. In addition, it is well known to direct a portion of the cold air flowing into the fresh food compartment downwardly through a air duct to and around a storage container or pan, thus maintaining the interior of the pan at a slightly lower temperature than other portions of the fresh food compartment. See, for example, U.S. Pat. Nos. 3,656,314; 3,126,721; 3,473,345 and 3,108,455. These pans are particularly useful for the preservation of fresh foods, such as fruit, vegetables and meat, so that they may be stored at temperatures somewhat below those of other stored foods.

It is desirable, however, that such pans have the temperature adjustable or controllable to provide the desired temperature inside the pan regardless of varying conditions that act on the refrigerating system. Such things as the degree of cooling, that is, the temperature of the air as it leaves the evaporator, often depend upon different ambient temperature conditions. For instance, when greater heat leakage occurs under high ambient temperature conditions, such as in the Summer, it often is necessary to provide for a greater circulation of the refrigerated air down to the pan to keep the inside at a proper temperature. Moreover, it is highly desirable to also control the temperature inside the pan, depending upon the type of food to be stored therein. In particular, when the pan is used for meat storage, the temperature should be lower than if the pan is used for fruits and vegetables. See, for example, U.S. Pat. Nos. 3,600,905 and 3,364,694, wherein there is shown two different arrangements for controlling the quantity of cold air flowing around the storage pan.

By our invention, there is provided an air flow control assembly whereby the user of the refrigerator may adjust the amount of cold air flowing around the pan and thus control the interior temperature of the pan.

SUMMARY OF THE INVENTION

According to one aspect of our invention, there is provided an air flow control assembly in a refrigerator having a freezer compartment on top and a fresh food compartment on the bottom which are separated by a partition and interconnected by an air duct located at the rear of the compartments. The air duct has an air inlet opening in the freezer compartment and an air outlet opening in the fresh food compartment. There is a movable damper for opening and closing the air duct outlet opening in the fresh food compartment and a storage pan located in air flow communication with the air duct outlet opening. A stationary cover is provided for the storage pan. There is control means including a movable control mechanism located at the front of the storage pan, a push rod linkage member having means at one end cooperating with the damper to open and close the air duct outlet opening upon movement of the push rod linkage member and the other end having means responsive to movement of the control mechanism for moving the push rod linkage member. With this arrangement, the user of the refrigerator may move the control mechanism to control the amount of cold air flowing around the pan and thus control the temperature inside the pan.

DESCRIPTION OF THE PREFERRED EMBODIMENT

Figure 1:
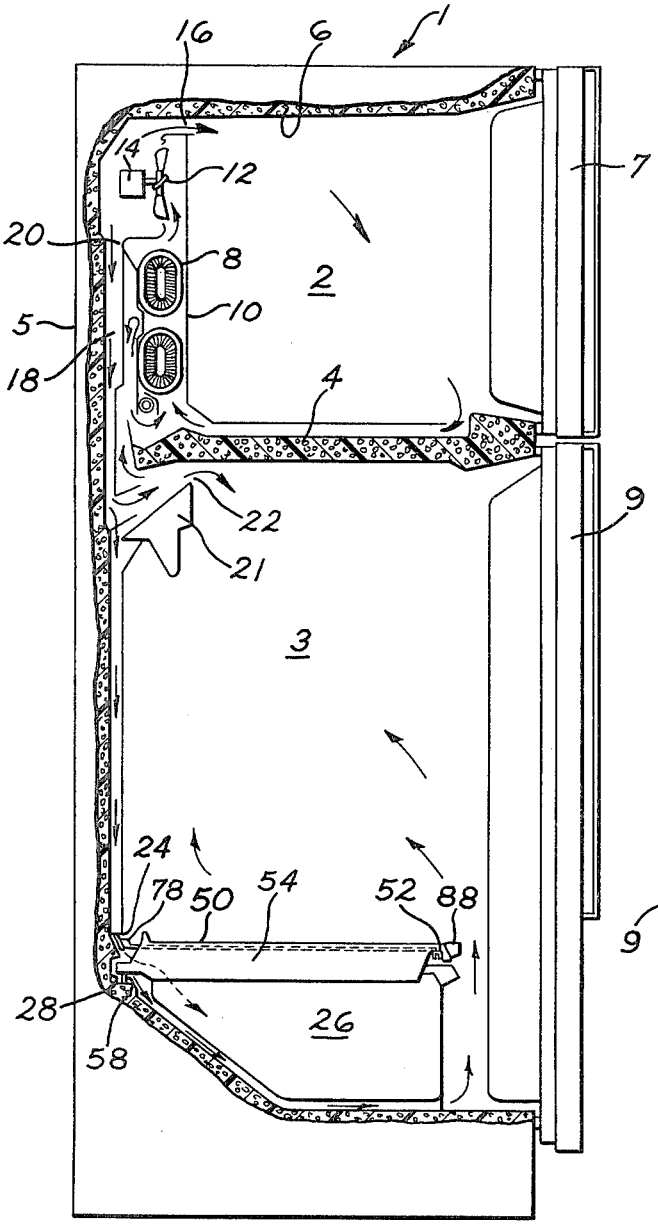
FIG. 1 is a side elevational view, partly in section, of a refrigerator cabinet having a freezer compartment on top and a fresh food compartment on the bottom and embodying one form of the present invention.
Figure 2:
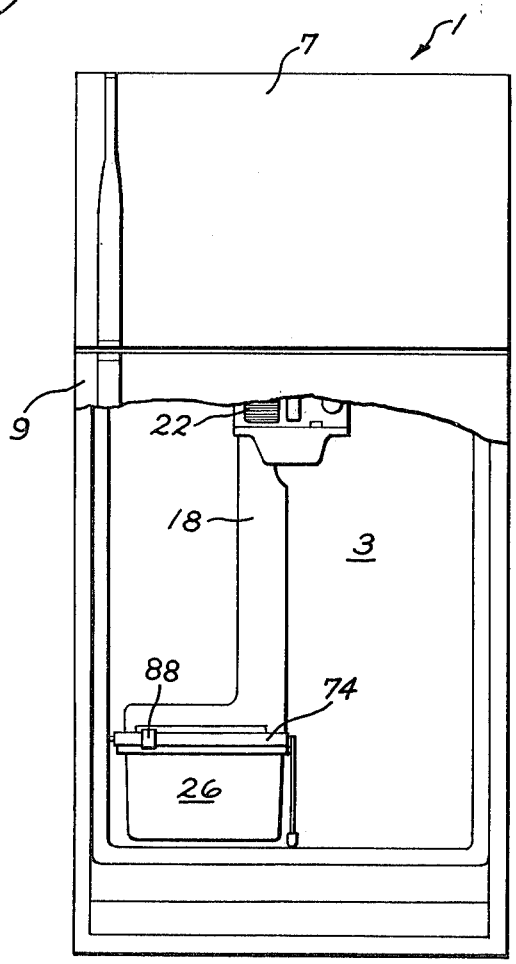
FIG. 2 is a front elevational view of the refrigerator of FIG. 1 having one form of the present invention embodied therein.

With particular reference to FIGS. 1 and 2 of the drawings, there is shown one embodiment of the present invention in the form of a household refrigerator 1, including an upper freezer compartment 2 and a lower fresh food compartment 3 separated from the freezer compartment by an insulated partition 4. The respective compartments are also separated from the outer shell or outer cabinet walls 5 and the spaces between the compartments and these walls are filled by means of insulation 6. A hinged door 7 permits access to the freezer compartment 2 and a hinged door 9 permits access to the fresh food compartment 3.

Both of the compartments are maintained at the desired refrigerating temperatures by means of a single evaporator 8 which operates at a below freezing temperature and is arranged within the freezer compartment 2 and separated from the food storage area of the freezer by a liner 10 for protection purposes. For directing air cooled by the evaporator 8 into the two compartments 1 and 2, there is provided a forced air circulating system, including a single air circulating means in the form of a fan 12 driven by a motor 14. Most of the air flow passes into the forward or food storage area portion of the freezer compartment 2 through air passage 16 while a smaller portion of the air is directed through an air duct 18 which is located at the rear of the compartments. The air duct 18 has an air inlet opening 20 in the freezer compartment 2 where the cold air enters the air duct and then it is directed downwardly to the fresh food compartment 3. The air duct 18 has a baffle 21 with a discharge opening 22 for introducing a portion of the cold air into the top of the fresh food compartment 3 while a portion of the cold air flow is directed downwardly through the air duct 18 to near the bottom of the fresh food compartment where there is an air outlet opening 24.

In household refrigerators, it is desirable to provide a pan in the fresh food compartment 3 in which fresh meat or fruits and vegetables may be kept and usually at a slightly lower temperature than the rest of the fresh food compartment. As shown in FIGS. 1 and 2, there is a pan 26 located at the bottom of the fresh food compartment 3 in air flow communication with the air duct outlet opening 24. The pan 26 is arranged to allow the cold air exiting the air outlet opening 24 to impinge upon and surround the pan 26 and thus lower the temperature inside the pan. The pan 26 is spaced slightly forward of wall 28 so that a variable cross section passageway 30 is provided to direct the flowing air from the air duct outlet opening 24 downwardly and then forwardly around the pan 26 then upwardly within the fresh food compartment 3. The air flow is shown by arrows in FIG. 1. By this direct contact of cold air on the pan 26, the temperature of the pan is maintained at a slightly lower temperature than the remainder of the fresh food compartment 3. It is desirable to control the temperature in the pan 26 and this may be accomplished by controlling the amount of cold air contacting and surrounding the pan from the air outlet opening 24. To accomplish this, there is provided an air flow control assembly, the operation and function of which will now be described.

Figures 3, 4:
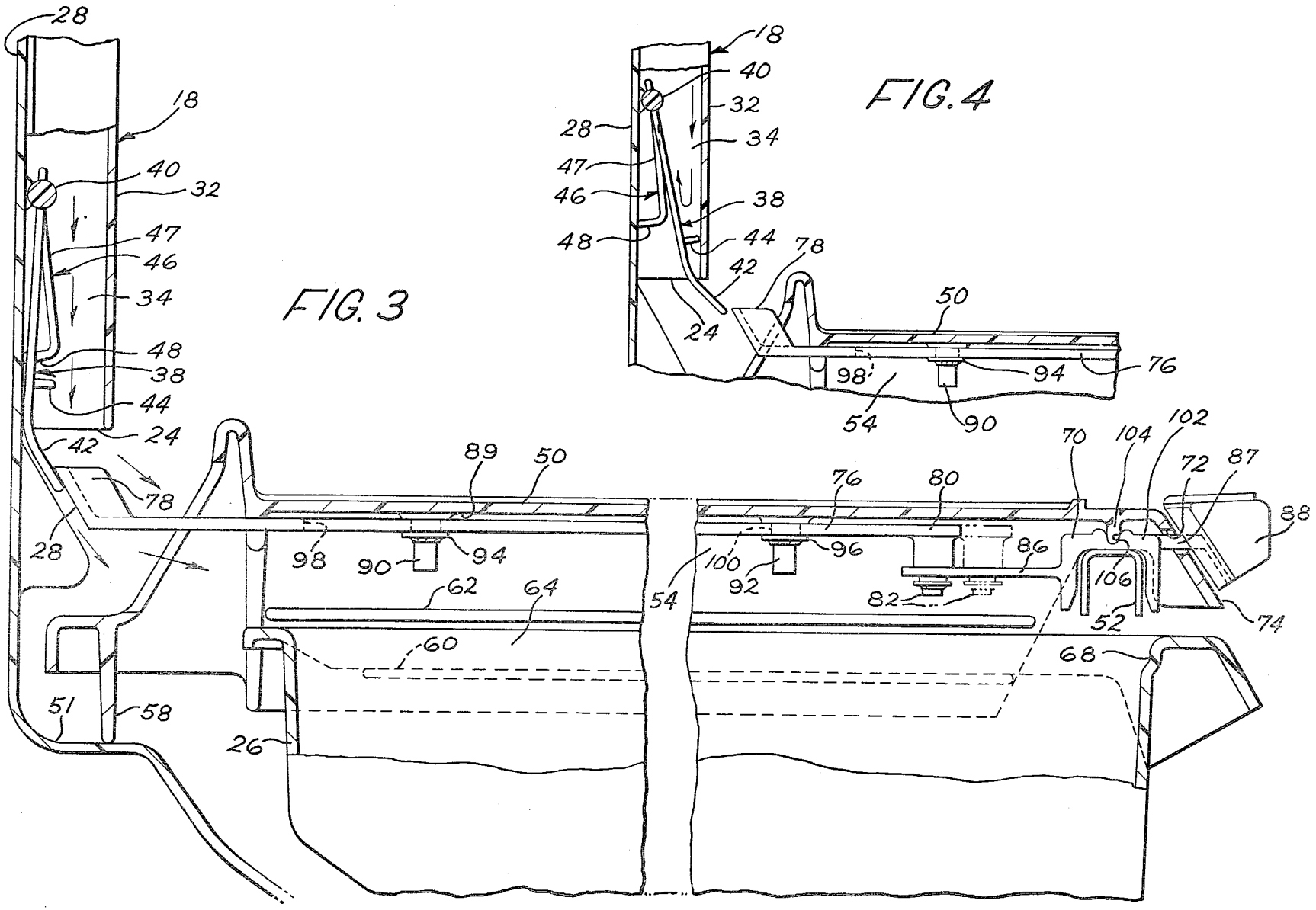
FIG. 3 is a cross sectional view of the air flow control assembly of the present invention showing one position of the control means.
FIG. 4 is a fragmentary cross-sectional view of a portion of the air flow control assembly of the present invention showing the control means in a second position.

With particular reference to FIGS. 3 and 4, the air duct 18 is formed by a channel member having a front wall 32 and side walls 34 and 36 and rear wall 28 of the refrigerator liner. The air outlet opening 24 discharges air in close proximity to the pan 26. There is provided in the air duct 18 a damper 38 that is pivotally connected to the air duct side walls 34 and 36 by a pin 40 to allow swinging movement of the damper within a defined scope. The lower end of the damper has a curved portion 42 which acts as an air deflector to cause the flow of cold air to be directed toward the pan 26. The damper 38 has a depending flange 44 which extends across the air outlet opening 24 to block and prevent any air from flowing through the air outlet opening 24 when the damper is in its closed position. The damper 38 also has one or more resilient fingers or springs 46 which are L-shaped in cross section and has one leg 47 attached to the damper 38 and the other leg 48 in contact with the liner wall 28. By this arrangement, the spring 46 acts to urge the damper 38 to a normally closed position as shown in FIG. 4. The entire damper 38 may be molded from suitable plastic material including the spring elements 46.

There is a stationary cover 50 which is secured to the inside of the fresh food compartment 3 by means of a rigid support member 52 passing through both of the downwardly depending side flanges 54 and 56 and attached to the inner wall of the fresh food compartment by any suitable means such as screws. The rear of the stationary cover 50 has a downwardly depending flange 58 which rests on a curved portion 51 of the wall 28. The stationary cover 50 has an inwardly open channel on both side flanges 54 and 56 dimensioned to slidably receive the pan 26. Both channels are of the same configuration. For instance, the channel on flange 54 uses the inner surface of the flange as the bottom wall and the two legs 60 and 62 are formed on the inner surface of flange 54 which are parallel to and spaced from each other to receive a downwardly turned lip 64 on each side of the pan 26. It will be readily understood that the pan 26 may be removed from the stationary cover 50 for cleaning, etc. and slides back and forth under the stationary cover on the tracks or channels provided in the side flanges 54 and 56 of the stationary cover 50.

Control means are provided for controlling or adjusting the amount of cold air flowing through the air outlet opening 24 which includes a movable control mechanism 70 which is located at the front of the storage pan 26 and in the preferred embodiment is slidably mounted with an arm 87 that passes through a horizontal slot 72 located on a panel 74 on the front of the stationary cover 50. There is a push rod linkage member 76 having means at one end 78 cooperating with the damper 38 to open and close the air duct outlet opening 24 upon movement of the push rod linkage member 76, and the other end 80 having means responsive to movement of the control mechanism 70 for moving the push rod linkage member 76. In the embodiment shown in the drawings, the means at one end 78 of the push rod linkage member 76 that cooperates with the damper 38 is a resilient bumper which, when moved rearwardly, engages the damper 38 and overcomes the spring tension of spring 46 and moves the damper to an open position, as shown in FIG. 3 and in full line in FIG. 5. The other end 80 has means such as stud 82 fastened to end 80 which is received in a slot 84 in a rigid cam arm 86 that is movable with the control mechanism 70. With stud 82 being movable within the slot 84 and fastened to the push rod linkage member 76, movement of the control mechanism 70 causes the stud 82 to move within the slot 84, thus causing push rod linkage member 76 to move back and forth.

The movable control mechanism 70 is provided with an arm 87 that passes through the horizontal slot 72 and has a knob 88 attached to it so that the user may easily move the control mechanism 70 to a position desired to regulate the damper 38 and thus control or adjust the amount of cold air impinging on the pan 26 and thus control the inside temperature of the pan 26. The push rod linkage member 76 may be secured to the bottom surface 89 of the stationary cover 50 by studs 90 and 92 with washers 94 and 96 respectively retaining the linkage member 76 in its proper position while slots 98 and 100 allow back and forth motion of the push rod linkage member 76.

Figure 5:
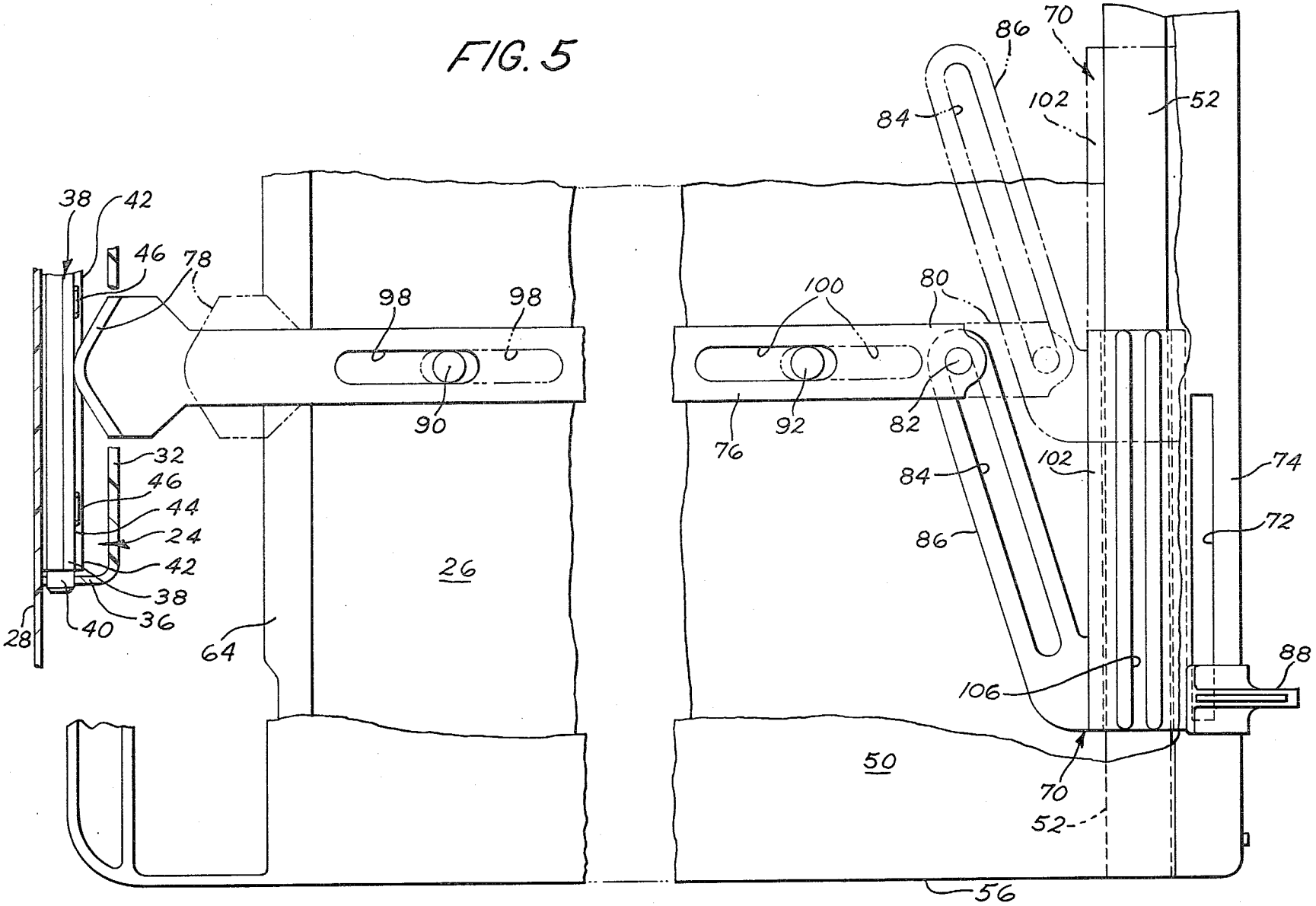
FIG. 5 is a top plan view of the present invention showing the control means of the present invention in two positions.

With reference to FIG. 5, the two extreme settings of the control mechanism 70 are shown. In full line when knob 88 and arm 87 and, therefore, control mechanism 70 are in the position shown, the push rod linkage member 76 is fully extended rearwardly so that end or bumper 78 contacts the curved portion 42 of the damper 38 and moves it rearwardly compressing the spring member 46 and opening the air outlet opening 24 to allow a maximum amount of cold air to flow through the air duct 18 and around the pan 26. When the knob 88 and arm 87 and, therefore, the control mechanism 70 are moved along the slot 72 to the right, as shown in FIG. 5, to the position shown in phantom, the stud 82 is moved within the slot 84 of the cam arm 86, thus moving the push rod linkage member toward the top of FIG. 5 which is the front of the pan 26, then the linkage member 76 is withdrawn and the bumper end 78 is removed from contact with the damper 38 allowing the spring 46 to urge the damper 38 to the closed position.

It will be noted that the control mechanism 70 has a body portion 102 which is U-shaped in cross section configuration as shown in FIG. 3 and rides upon the support member 52, thus helping to keep the movable control mechanism 70 in alignment during movement by the refrigerator user along the forward portion of the stationary cover 50. There is also provided a ridge 104 molded in the cover 50 which, in cooperation with a groove 106 on the control mechanism 70, acts as a guide rail.

The foregoing is a description of the preferred embodiment of the invention and it should be understood that variations may be made thereto without departing from the true spirit of the invention as defined in the appended claims.

What is claimed is:

1. In a refrigerator having a freezer compartment on top and a fresh food compartment on the bottom, the two compartments being separated by a partition and interconnected by an air duct located at the rear of the compartments, said air duct having an air inlet opening in the freezer compartment and an air outlet opening in the fresh food compartment, an air flow control assembly comprising:

a movable damper for opening and closing the air duct outlet opening, a storage pan in the fresh food compartment in air flow communication with the air duct outlet opening, a stationary cover for the storage pan, and control means including a movable control mechanism located at the front of the storage pan, a push rod linkage member having means at one end cooperating with the damper to open and close the air duct outlet opening upon movement of the linkage member and the other end having means responsive to movement of the control mechanism for moving the push rod linkage member.

2. In the refrigerator of claim 1 wherein the means responsive to movement of the control mechanism for moving the push rod linkage member is a slotted cam arm movable with the control machanism and a stud fastened to one end of the push rod linkage member located and movable within the cam arm slot.

3. In the refrigerator of claim 1 wherein the push rod linkage member is movably secured to the cover of the storage pan.

4. In the refrigerator of claim 1 wherein the movable control mechanism includes an arm slidable within a horizontal slot located on the front of the stationary cover.

5. In the refrigerator of claim 1 wherein the movable control mechanism may be positioned anywhere between the position opening the damper and closing the damper to thereby allow variable control of the cold air flowing through the air duct outlet opening.

6. In the refrigerator of claim 1 wherein there is an air flow passageway around the storage pan in communication with the air duct outlet opening.

7. In the refrigerator of claim 1 wherein the pan is supported by the stationary cover and is movable back and forth relative to the stationary cover and is removable therefrom.

8. In the refrigerator of claim 1 wherein the damper has means to bias the damper to a normally closed position.

9. In the refrigerator of claim 8 wherein one position of the movable control mechanism allows the push rod linkage member to overcome the bias means of the damper and open the air duct outlet opening and a second position of the control mechanism moves the push rod linkage member to a position that allows the biasing means on the damper to close the air duct outlet opening.

10. In the refrigerator of claim 8 wherein the means to bias the damper is a spring secured to the damper that contacts a wall of the air duct to bias the damper to its normally closed position.

* * * * *